US005751599A

United States Patent [19]

Bortnik et al.

[11] Patent Number: 5,751,599

[45] Date of Patent: May 12, 1998

[54] PROBELESS MICROPROCESSOR BASED CONTROLLER FOR OPEN RECIRCULATING EVAPORATIVE COOLING SYSTEMS

[76] Inventors: Michael Bortnik, 1107½ 18th St., Santa Monica, Calif. 90403; Vadim A. Sadovsky, 3150 Isherwood Way, Fremont, Calif. 94536

[21] Appl. No.: 694,802

[22] Filed: Aug. 9, 1996

Related U.S. Application Data

[63] Continuation-in-part of Ser. No. 678,636, Jul. 10, 1996, abandoned.

[51] Int. Cl.[6] ..... F25B 39/04; G08B 21/00

[52] U.S. Cl. ..... 364/505; 364/496; 261/DIG. 11; 137/5; 137/91

[58] Field of Search ..... 261/DIG. 11, DIG. 46, 261/111, 110; 210/96.1, 167, 198.1, 206, 700, 743, 101, 143, 698, 753, 749; 62/305.85; 137/5, 91, 93, 88; 165/95; 204/433, 400; 324/438, 425; 364/496, 505

[56] References Cited

U.S. PATENT DOCUMENTS

| | | | |
|---|---|---|---|
| 3,754,741 | 8/1973 | Whitehurst et al. | 261/151 |
| 3,759,387 | 9/1973 | Drayton, Jr. | 210/98 |
| 4,009,577 | 3/1977 | Allen | 60/692 |
| 4,144,722 | 3/1979 | Mattwell | 62/305 |
| 4,170,550 | 10/1979 | Kamody | 423/225 |
| 4,285,392 | 8/1981 | Rannow | 165/50 |
| 4,460,008 | 7/1984 | O'Leary et al. | 137/93 |
| 4,464,315 | 8/1984 | O'Leary | 261/110 |
| 4,475,356 | 10/1984 | Lewis | 62/183 |
| 4,836,239 | 6/1989 | Kinkead | 137/413 |
| 4,873,650 | 10/1989 | Reeves, Jr. | 364/510 |
| 5,056,036 | 10/1991 | Van Bork | 364/510 |
| 5,057,229 | 10/1991 | Schulenburg et al. | 210/743 |
| 5,144,811 | 9/1992 | Brodie et al. | 62/176.6 |
| 5,147,559 | 9/1992 | Brophey et al. | 210/744 |
| 5,213,694 | 5/1993 | Craig | 210/744 |
| 5,294,916 | 3/1994 | Bolton et al. | 340/606 |
| 5,368,826 | 11/1994 | Weltz et al. | 422/243 |
| 5,398,711 | 3/1995 | Ardrey, Jr. | 137/5 |
| 5,435,969 | 7/1995 | Hoots et al. | 422/14 |
| 5,504,693 | 4/1996 | Elliott et al. | 364/510 |

*Primary Examiner*—James P. Trammell
*Assistant Examiner*—Cuong H. Nguyen
*Attorney, Agent, or Firm*—Lewis B. Sternfels

[57] ABSTRACT

An open recirculating evaporative cooling system includes a cooling tower or evaporative condenser (12) having a heated water inlet (20) and a water collection basin (22), a water supply (34) for supplying a volume of water to the cooling tower, a water supply meter (36) coupled between the cooling tower and the water supply, for registering the volume of water supplied to the cooling tower from the water supply and for providing pulse information corresponding to the volume of water supplied, a heat exchanger (16) coupled to the cooling tower basin for receiving water therefrom, for removing waste heat (18) from heat producing equipment, and for supplying the heated basin water to the cooling tower heated water inlet, a solenoid valve (30) coupled between the heat exchanger and a drain for draining water from the cooling tower basin through the heat exchanger, sources of water treatment (24, 26, 28) coupled to the cooling tower for supplying corrosion and scale and biological fouling controlling additives thereto, and a microprocessor controller (38) connected to the water supply meter, the drain valve and the water treatment sources for receiving the pulse information from the water meter in terms of volume (gallons, liters, etc.) per pulse, and for controlling both the water treatment sources for the supply of the corrosion and scale and biological controlling additives to the cooling tower and the draining valve for draining water from the cooling tower basin.

17 Claims, 5 Drawing Sheets

+VCC2
54
52
ROM
XRAM
+VCC2
+VCC2
ADDRESS
CODE DATA
ADDRESS
DATA
44
42
DATE/TIME DATA
MCU
M/D DATA
M/D CONTROL
D DATA
D CONTROL
L DATA
L CONTROL
38
+VCC2
DISPLAY
LATCHES
48
MULTI-PLEXER DEMULTI-PLEXER
46
50
WATER METER DATA
86
88
RELAY DRIVER
NUM. DATA
84
78
SCROLL
82
76
STATUS
ENTER
80
58
P
T
74
E
M
68
64
FEED
BLEED OFF
66
62
70
72
ALARM
60
BIOCIDE A
BIOCIDE B
AC/DC ADAPTER
+VCC1
+VCC2
+VCC1
56
90
RESERVE BATTERY
+VCC2
92

PROBELESS MICROPROCESSOR BASED CONTROLLER FOR OPEN RECIRCULATING EVAPORATIVE COOLING SYSTEMS

This is a continuation-in-part of application Serial No. 08/678/636 filed 10 Jul. 1996, now abandoned.

REFERENCE TO SOURCE CODE APPENDIX

Attached hereto and incorporated herein is Appendix A, which is the hard copy printout of the source code for the "051 Assembly" language computer programs which program (configure) the processors and computers disclosed herein to implement the methods and procedures described herein. Appendix A consists of 1 title page, listing 27 files, and 149 pages. This source code is subject to copyright protection. The copyright owner has no objection to the facsimile reproduction of the patent disclosure, as it appears in the Patent and Trademark Office patent files or records, but otherwise reserves all copyright rights whatsoever.

BACKGROUND OF THE INVENTION

1. Field of the Invention

The present invention relates to open recirculating evaporative cooling systems, commonly called cooling towers and evaporative condensers, and, in particular, to apparatus and methods for probeless control of such cooling systems.

2. Description of Related Art and Other Considerations

Open recirculating evaporative cooling systems are designed for removal of waste heat generated by industrial process equipment, refrigeration and air conditioning systems, computer cooling jackets and other commercial and industrial systems. The removal of such waste heat occurs through evaporation of recirculating water in a cooling tower or an evaporative condenser. Because it is common to interchange cooling tower for evaporative condenser, and vice-versa, it is to be understood that the two are considered equivalent herein.

The cooling tower recirculation process may be described as follows. Cooling water from the basin of the tower is pumped through heat exchangers or cooling jackets, where the water picks up waste heat from operating equipment. The water is directed back to the top of the cooling tower where, using different methods, water droplets are formed and fall to the tower basin. A stream of cooling air, such as generated by large fans, is directed upwardly against the falling water droplets and, upon contact with the droplets, promotes evaporation, thus resulting in removal of the waste heat. Evaporated water escapes from the tower and the remaining water droplets reaching the tower basin have a temperature which is lower than that of the water inserted into the tower at its top.

Due to evaporation and a process called "blowdown" (described below), the water available for cooling purposes is depleted. This lost water must be replaced by make-up water; replacement is achieved by use of a level activated valve which is connected to a water supply. The level activated valve senses when the water level in the tower basin drops below a predetermined point and opens to supply water to the tower basin until the water level again reaches its desired level. The volume of replaced or make-up water is measured by a conventional water meter.

This make-up water contains dissolved minerals and other solids which, over a period of time, increase the mineral content in the system water. This mineral content is defined as total dissolved solids or "TDS." The concentration of dissolved solids or TDS must be controlled at a prescribed or calculated level as determined by water quality parameters and the water treatment program, such as established by environmental and/or equipment maintenance regulations. An important measurement of TDS is known as cycles of concentration of minerals occurring during the process. The number of cycles of concentration (CC) of minerals is determined by the relationship of the TDS content in the cooling tower water with respect to the TDS content in make-up water or, expressed as an equation, $$CC = \frac{TDS \text{ content in the cooling tower water}}{TDS \text{ content in make-up water}}$$

Undesirably high cycles of concentration in tower water cause scale deposits, which eventually render the system inefficient and inoperable.

Therefore, to control the TDS in the tower water at a predetermined desired level, an outlet valve in the tower basin, typically a solenoid valve, must be periodically opened to drain or "bleed off" an amount of tower water containing the high total dissolved solids concentration and replacing this bleed-off water with less concentrated make-up water, thereby lowering the concentration of total dissolved solids. This discharge, to drain or bleed-off water, is called "blowdown." This water loss through blowdown is also furnished from the water supply, and is likewise measured by the water meter.

Furthermore, water in the cooling tower contains chemical additives which are used to control both corrosion, scale and general fouling and biological fouling in the system. Thus, when water is bled off from the basin, this "bleed-off" water contains not only high levels of dissolved solids, but also some of the chemical water treatment additives. Because it is important that the concentration of these chemical treatments be maintained at proper recommended levels for proper performance, these treatments must be added to the tower water after water is bled from the system.

Conventional management in a cooling tower system employs an automatically controlled blowdown method and associated equipment, including a probe to measure the electrical conductivity of the tower water. When the conductivity reaches a predetermined point corresponding to an undesirably high concentration of total dissolved solids, a signal from the probe is fed through appropriate electrical circuitry to open the bleed-off valve. The conductivity measurement method requires the use of such equipment as a conductivity sensor or probe, special plumbing to furnish tower water to the conductivity sensor and back to the tower, a flow switch to shut off power to the controller when the cooling tower is idle, and maintenance, repair and calibration of the conductivity probe and related components.

Standard conductivity probes become fouled with deposits of dirt, minerals, etc. over time, which deposits reduce the accuracy of the probe. Accordingly, the probes need to be periodically replaced when their accuracy falls outside tolerance range, after all cleaning and calibration procedures are performed. Furthermore, the use of such probes, their maintenance, repair and replacement, and associate equipment adds considerable cost to the system.

SUMMARY OF THE INVENTION

These and other problems are successfully addressed and overcome by the present invention. Briefly, the above-mentioned water meter produces pulses which reflect the volume of make-up water. These pulses are utilized in the method and apparatus of the present invention to calculate a timed program for blowdown and resupply of chemical additives.

Specifically, the water meter in the make-up line sends one or more pulses to a microprocessor controller, to reflect the volume (gallons, liters, etc.) of make-up water added to the tower. The controller is programmed to automatically calculate the times and duration for opening the drain or bleed-off valve and, in coordination with bleed-off, for resupply of the chemical additives, in accordance with the following mathematical formula relating to make-up water to blowdown rate and cycles of concentration:

$$BDT = \frac{MU}{BDR \times CC} \text{ minutes/pulse}$$

where BDT=time of blowdown, MU=make-up (volume per pulse), BDR=blowdown rate (volume per minute), and CC=cycles of concentration.

More specifically, the recirculating evaporative cooling system includes a cooling tower having an inlet for receiving water heated from waste heat and a water collection basin, a water supply for supplying a volume of water to the cooling tower, a water supply meter coupled between the cooling tower and the water supply, for registering the volume of water supplied to the cooling tower from the water supply and for providing pulse information corresponding to the volume of water supplied, a heat exchanger coupled to the cooling tower basin for receiving cooled water therefrom, for removing waste heat from heat producing equipment, and for supplying the heated water to the cooling tower, a valve coupled between the heat exchanger and a drain for draining water from the cooling tower basin through the heat exchanger, sources of water treatment coupled to the cooling tower for supplying corrosion and scale and biological fouling controlling additives thereto, and a microprocessor controller connected to the water supply meter, the drain valve and the water treatment sources for receiving the pulse information from the water meter in terms of number of pulses, and for controlling both the water treatment sources for the supply of the corrosion and scale and biological controlling additives to the cooling tower and the draining valve for draining water from the cooling tower basin.

Several advantages are derived from this arrangement. Conductivity measuring probes and associated equipment are eliminated, thus reducing the costs and problems attendant thereto. Control of resupplying make-up water and chemical additives to the cooling tower are simplified.

Other aims and advantages, as well as a more complete understanding of the present invention, will appear from the following explanation of an exemplary embodiment and the accompanying drawings thereof.

DETAILED DESCRIPTION OF THE PREFERRED EMBODIMENTS

Figure 1:
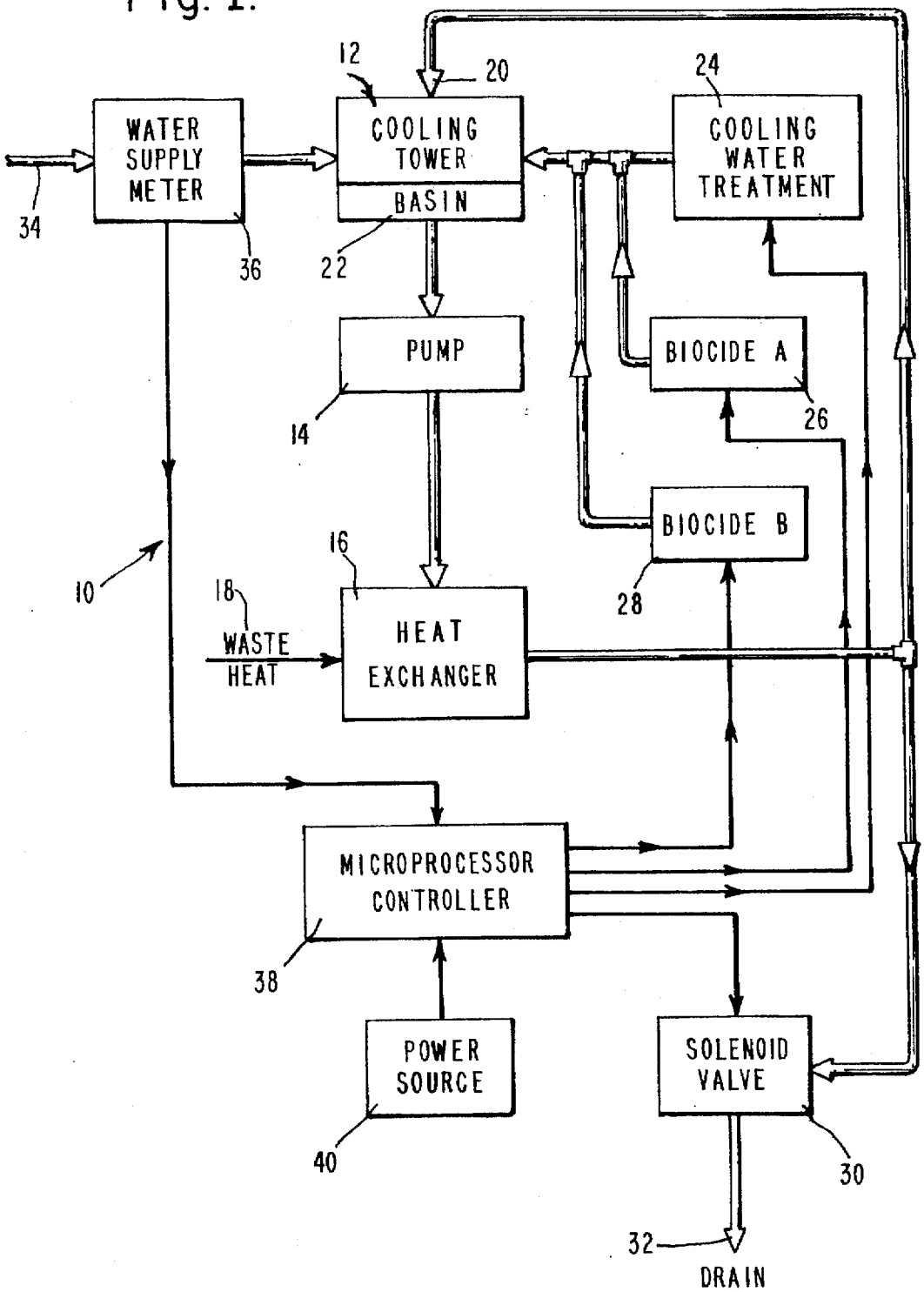
FIG. 1 is a block diagram depicting a cooling tower and probeless microprocessor controller therefor embodied in accordance with the present invention.

Accordingly, FIG. 1 depicts an open recirculating evaporative cooling system 10 comprising a cooling tower 12, a pump 14 and a heat exchanger or cooling jacket 16. Heat exchanger 16 picks up waste heat from operating equipment, as denoted by indicium 18. The cooling tower is of conventional construction and includes a heated water input or inlet 20, a basin 22 for collecting cooled water, and apparatus therebetween for cooling the heated water entering through input 20. The cooling apparatus employs known methods in which water droplets are formed and fall to tower basin 22. In such a cooling apparatus, a stream of cooling air, such as generated by large fans, is directed upwardly against the falling water droplets and, upon contact with the droplets, promotes evaporation, thus resulting in removal of the waste heat. Evaporated water escapes from the tower and the remaining water droplets reaching the tower basin have a temperature which is lower than that of the water inserted into the tower at its top through inlet 20.

To control corrosion, scaling, biological and other such fouling of the system, the water in the system must be treated such as by sources 24, 26 and 28, respectively to supply (1) a cooling water treatment to counteract corrosion and scaling and (2) biocides "A" and "B" to control biological problems.

Periodically, by a "blowdown" process, basin water is bled from the basin and, therefore, from the system, through a valve 30 for disposal into an appropriate drain, as denoted by indicium 32. Preferably, valve 30 is embodied as a solenoid valve. As stated above, this lost water is replaced by make-up water by conventional apparatus, not shown, such as by use of a level activated valve which is connected to a water supply. The level activated valve senses when the water level in tower basin 22 drops below a predetermined point and opens to supply water to the tower basin through a conduit 34 until the water level again reaches its desired level. The volume of replaced or "make-up" water is measured by a conventional water meter 36.

Control of recirculating evaporative cooling system 10 is effected by a microprocessor controller 38 powered from a source of power 40. Controller 38 is coupled to cooling water treatment source 24, biocide "A" and "B" sources 26 and 28 and solenoid valve 30 to cause operation or activation thereof, and to water supply meter 36 for receiving information therefrom in the form of pulses.

Although water supply meter 36 is of conventional construction, its use is of great importance in the practice of the present invention. Specifically, the meter provides pulses which measure the volume of water supplied to cooling tower 12. As stated above, the term, cycles of concentration (CC), is related to the mineral content in the system, specifically, its total dissolved solids or "TDS" and is defined by the relationship of the TDS content in the cooling tower water with respect to the TDS content in make-up water or, expressed as an equation, $$CC = \frac{TDS \text{ content in the cooling tower water}}{TDS \text{ content in make-up water}}$$

Undesirably high cycles of concentration in tower water cause scale deposits, which eventually render the system inefficient and inoperable.

These pulses from meter 36 are entered into microprocessor in terms of a pulse group in contrast to a pulse, per se, in order to accommodate different types of meters and their abilities to pulse at different volumes of water supplied to the cooling tower. The reason, for defining the volume of water as a "pulse group" rather than as a pulse, is that the capacities of meters vary from cooling tower to cooling tower. Thus, one must have the ability to program the microprocessor for the meter already existing at a particular cooling tower.

Specifically, a water meter generates an electric pulse for a given number of gallons or other volumetric measure. Thus, one meter may provide a pulse at a 25 gallon make-up while another meter may provide a pulse at a 50 gallon make-up. In the practice of the present invention, it is important that the pulse information received by the microprocessor be uniform and not specific to any one water meter. To effect this uniformity, the pulse information is input into microprocessor 38 as a number of pulses in a group. For example, if the design of the water meter is to send a pulse after each 25 gallons of make-up water fed to the tower, and it is desired to have the microprocessor process a make-up of 50 gallons, then the number of pulses in the group is 2. However, if the water meter design is to send a pulse after a 50 gallon feed, then the number of pulses in the group is 1.

While the use of water supply meter 36 is said above to be of great importance, this is so only because it provides the necessary water capacity information required by microprocessor controller 38. Accordingly, it is to be understood that the present invention contemplates the use of any means by which water capacity information is obtained for controller 38, whether by meter 36, per se, or other implementation.

These and other inputs into microprocessor 38, as will be more fully described below with respect to FIGS. 2 and 4, include the current time and date, the cycles of concentration and its bleed and feed cycle time calculation, the make-up (volume/pulse) and its bleed and feed cycle time calculation, the blowdown rate (volume/minute) and its bleed and feed cycle time calculation, the number of pulses in the group, the biocide "A" and "B" schedules and their lockout durations, and a customized password for the customer. These factors are utilized in the microprocessor which calculates the opening time for the "bleed-off" valve and, thus, to maintain the concentration of total dissolved solids (cycles of concentration) in the tower water at a certain level.

The mathematical formula used in the microprocessor is derived using cooling tower process calculations, based upon the following considerations:

(1) The number of volumetric quantity (e.g., gallons and liters) of make-up water generating a pulse as known from the meter's specification.

(2) The volume per pulse parameter that is programmed into the controller's microprocessor's memory, (3) The blowdown rate expressed in volume per minute that is known from the system's specification or simply that can be measured using a vessel and a watch, (4) Cycles of concentration (c/c) value that is calculated for a specific water treatment program routinely before the start of the program, and (5) The blowdown rate in volume per minute and the cycles of concentration that are also programmed into the controller's microprocessor memory when the controller is programmed for operation.

The microprocessor calculates the opening time for the "bleed-off" valve, with coordination of water treatment, to maintain the concentration of total dissolved solids (cycles of concentration) in the tower water at a desired level. Separately, the time for biocide insertion is also scheduled by the microprocessor.

The following terms in the equations used to determine the mathematical formula used in the microprocessor controller, are defined as follows:

BDR=Blowdown rate (volume per minute)

BDT=Blowdown time (minutes per pulse)

CC=Cycles of concentration (a pure number)

EVR=Evaporation rate (volume per minute)

MU=Make-up (volume per pulse)

MUR=Make-up rate (volume per minute)

Accordingly, the blowdown time is determined by comparing the make-up water to the rate of blowdown and the cycles of concentration, or $$BDT = \frac{MU}{BDR \times CC} \text{ minutes per pulse} \quad (1)$$

The calculation formula (1) is derived using common cooling tower process calculations, where blowdown is related to evaporation and cycles of concentration, as follows, $$BDR = \frac{EVR}{CC-1}, \text{ or } EVR = BDR(CC-1) \quad (2)$$

The make-up rate (MUR) required is determined by the volume of water which has been lost per minute through the rate of evaporation (EVR) and the rate of blowdown (BDR), or $$MUR = EVR + BDR. \quad (3)$$

Substituting equation (2) into equation (3), $$MUR = BDR(CC-1) + BDR,$$

or $$MUR = BDR \times CC - \cancel{BDR} + \cancel{BDR} = BDR \times CC. \quad (4)$$

It can be established that make-up (MU) volume per pulse group for the system shown in FIG. 1 is determined by multiplying the make-up rate (MUR) by blowdown time (BDT), or $$MU = MUR \times BDT. \quad (5)$$

Substituting equation (4) into equation (5), $$MU = BDR \times CC \times BDT, \quad (6)$$

and, rearranging equation (6) for time of blowdown (BDT), $$BDT = \frac{MU \text{ (volume/pulse)}}{BDR \text{ (volume/minute)} \times CC}, \text{ or minutes/pulse,} \quad (4)$$

which is the required mathematical formula used by microprocessor controller 38.

Figure 2:
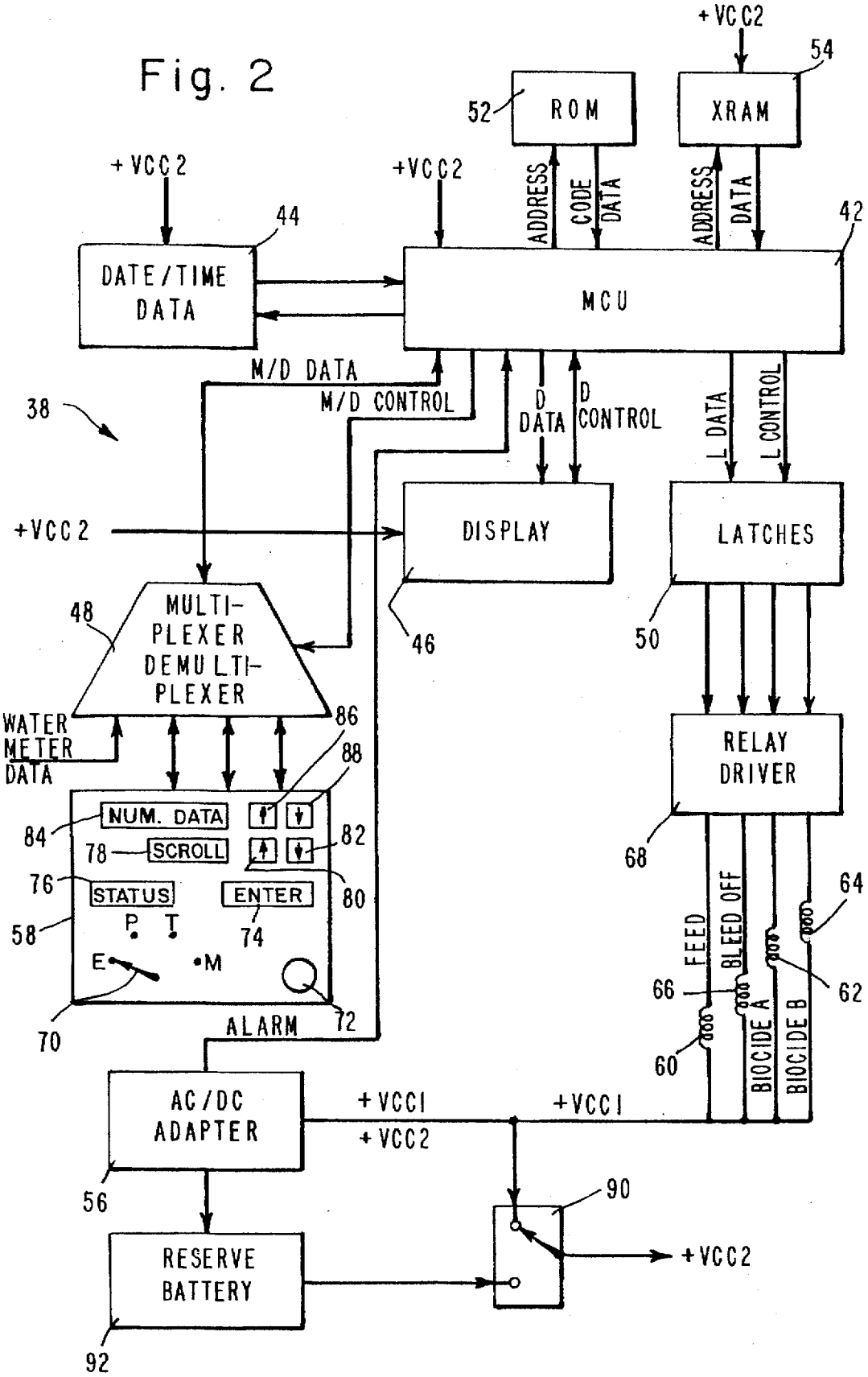
FIG. 2 is a block diagram of the microprocessor and related electronics for controlling the cooling tower.

As illustrated in FIG. 2, microprocessor controller 38 includes a microcontroller unit 42 (MCU), e.g., an Intel 8032 chip, which is coupled to a clock-calendar, chip 44, a display 46, a multiplexer/demultiplexer 48, latches 50, a read-only memory (ROM) 52, an external data memory (XRAM) 54, and an alternating/direct current (AC/DC) adapter 56. Clock-calendar chip 44 establishes date and time information. Instructions and results of controller operations on different modes are shown on display 46, for example, a liquid crystal display (LCD). Multiplexer/demultiplexer 48 is coupled to a control panel 58 and comprises a bidirectional switch for information exchange between MCU chip 42 and the control panel, as well as between the MCU chip and external devices, such as water meter 36.

Cooling water treatment source 24, biocide "A" and "B" sources 26 and 28, and solenoid valve 30 are actuated by their respective relay coils 60–66, which are coupled to latches 50 through a relay driver 68. Latches 50 generate the signals to drive relay driver 68 and, thus, relays 60, 62, 64, 66 necessary for the valves in sources 24, 26, 28 and solenoid 30 to be opened and closed, or turned on and off.

External read-only-memory (ROM) 52 is used to store the controller code. External data memory (XRAM) 54, while optional, is used to store the information entered by an operator in the Programming Mode, which will be explained shortly with reference to FIG. 4.

Figure 3:
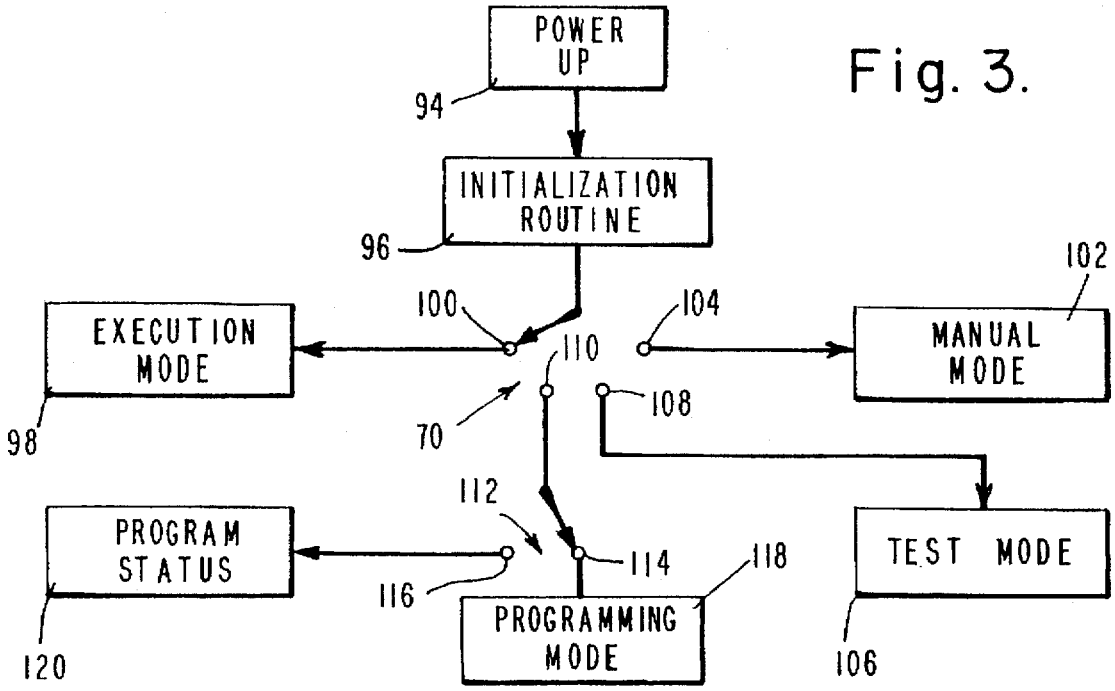
FIG. 3 is a block diagram of the mode switch and other functions illustrated in FIG. 2.

Control panel 58 comprises the interface for the operator (1) to enter information in the programming mode (through a mode switch 70 at position "P"), (2) to provide execution according to the information entered (through mode switch 70 at position "E"), (3) to test the controller and cooling system workability (through mode switch 70 at position "T"), and (4) to operate the controller manually (through mode switch 70 at position "M"). These positions are also shown in FIG. 3 for further describing the mode switch and other functions. Control panel 58 also includes a power up switch 72 which also lights up to indicate when the power is on, an enter button or key 74 (labelled "ENTER"), a status button or key 76 (labelled "STATUS"), a scroll label 78 ("SCROLL") with its respective scroll up and scroll down buttons or keys 80 and 82, and a numerical data label 84 ("NUM. DATA") with its respective up and down buttons or keys 86 and 88.

A power supply subsystem is connected to microprocessor 38 through AC/DC adapter 56 and provides direct current (DC) voltages VCC1 and VCC2 for controller operation. Voltage VCC1 is the voltage source for every day operation and is interruptible. Voltage VCC2 is a switchable voltage source, effected by a switch 90, and allows a backup or reserve battery 92 to be used automatically when interruption of the source of alternating current (AC) through adapter 56 is sensed by the microprocessor. The battery is automatically recharged by adapter 56. Battery 92 is connected only to external data memory (XRAM) 54, date/time data chip 44, MCU chip 42, and display 46. Therefore, if there is an interruption in the power from its alternating current source, MCU chip 42 automatically goes to standby mode and all operations are "frozen" and, accordingly, the data memory (XRAM) 54 and the internal MCU RAM content will not change. When alternating current power is restored, the controller returns to its normal operation.

The modes obtained through switch 70 at the programming "P", execution "E", test "T" and manual operation "M" positions discussed above with respect to FIG. 2 are further described in FIG. 3. Briefly, when the system is turned on, as denoted by "POWER UP" enclosure 94, the initialization routine commences, as so stated in enclosure 96. Then, depending upon the positioning of the switch arm in switch 70 at appropriate contacts, one of the following operations or events occurs: execution mode (enclosure 98) at contact 100, manual mode (enclosure 102) at contact 104, test mode (enclosure 106) at contact 108 and, at contact 110, one of two modes. The selection of these modes depends upon the positioning of a switch 112 at one of its contacts 114 and 116, respectively to programming mode (enclosure 118) and to program status (enclosure 120).

Figure 4:
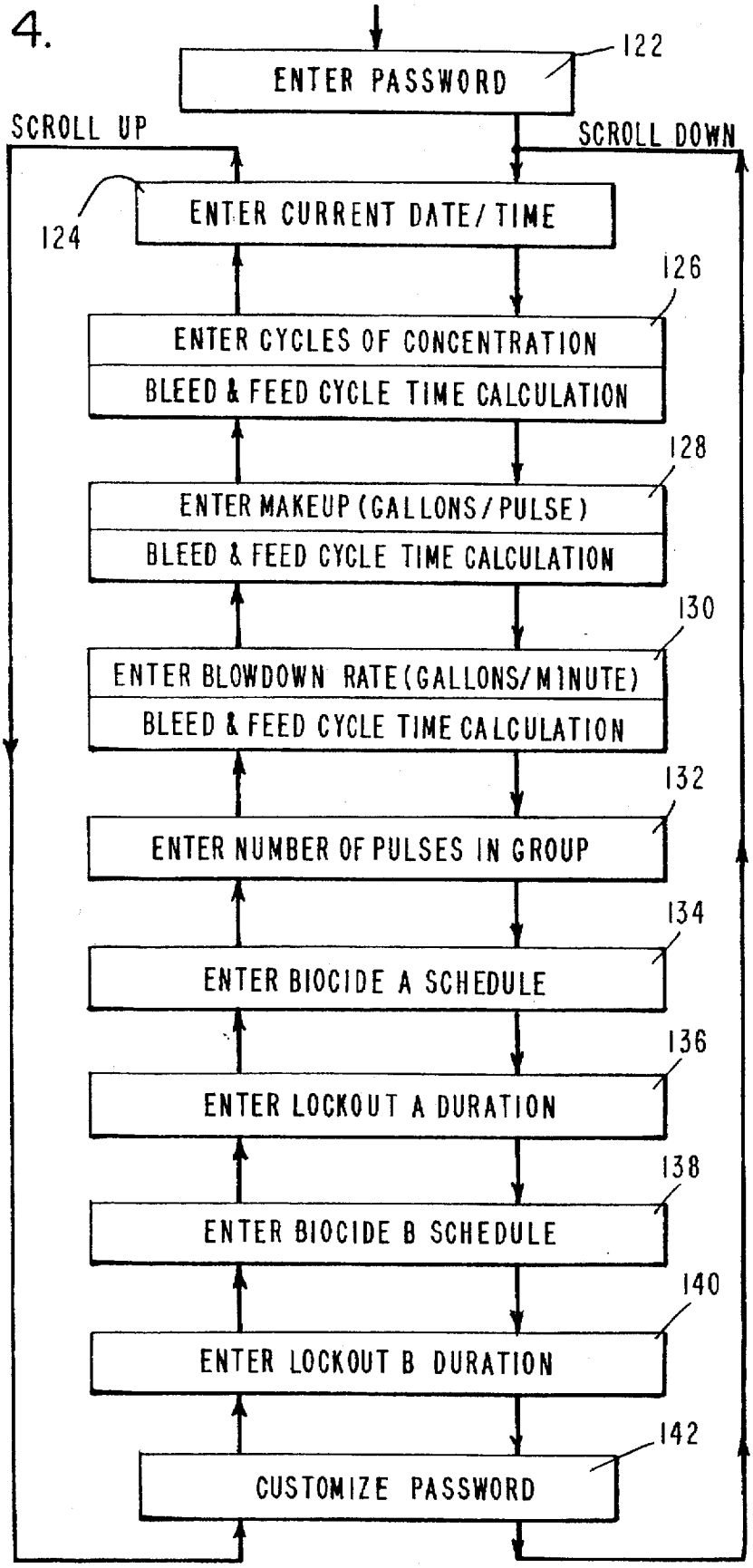
FIG. 4 depicts a series of steps defining the programming mode of the present invention.

The steps for effecting programming are outlined in FIG. 4. These programming steps commence when the switch arm of switch 70 is positioned at program "P" (FIG. 2) which, in turn in FIG. 3, corresponds to the positioning of switch 70 at contact 110 and of switch 112 at contact 114 for its "PROGRAMMING MODE" (enclosure 118).

All programming of values into microprocessor 38, as described with respect to FIG. 4, are effected by use of buttons or keys 80, 82, 86 and 88 in control panel 58 (see FIG. 2).

As depicted in FIG. 4, initiation of programming commences with the entry of a general password (enclosure 122). This password will be customized for a particular customer at a later time. Then, the current date and time information is entered (enclosure 124), followed sequentially with the entry of the cycles of concentration (enclosure 126) with its bleed and feed cycle time calculation, make-up (enclosure 128) with its bleed and feed cycle time calculation, blowdown rate (volume/minute) (enclosure 130) with its bleed and feed cycle time calculation, number of pulses in group (enclosure 132), biocide "A" schedule (enclosure 134), lockout "A" duration (enclosure 136), biocide "B" schedule (enclosure 138), lockout "B" duration (enclosure 140), and customization of the password (enclosure 142).

Entry of the values for cycles of concentration (enclosure 126), make-up (enclosure 128) and blowdown rate (enclosure 130) are established beforehand and entered into external data memory (XRAM) 54.

The number of pulses in the group (enclosure 132) are then entered into the microprocessor. As described above, this entry comprises a pulse group number, as distinguished from a pulse, per se, to compensate for varying capacities of existing water meters found at different cooling towers.

Biocide schedules and lockout durations (enclosures 134–140) are entered for each biocide. The scheduling information relates to the starting date and time of each biocide insertion, and to the length of time of its insertion. Lockout relates to biocide insertion vis-a-vis blowdown. It is important that, immediately following insertion of a biocide per its schedule, blowdown be prevented, to allow the biocide to work for a designated time and, therefore, to thwart any loss of the effects of biocide treatment.

Finally, with coordination with the customer, the password is customized (enclosure 142) so that operation of the recirculating evaporative cooling system is secure to that customer's cooling tower and to prevent any mischievous tampering.

Figure 5:
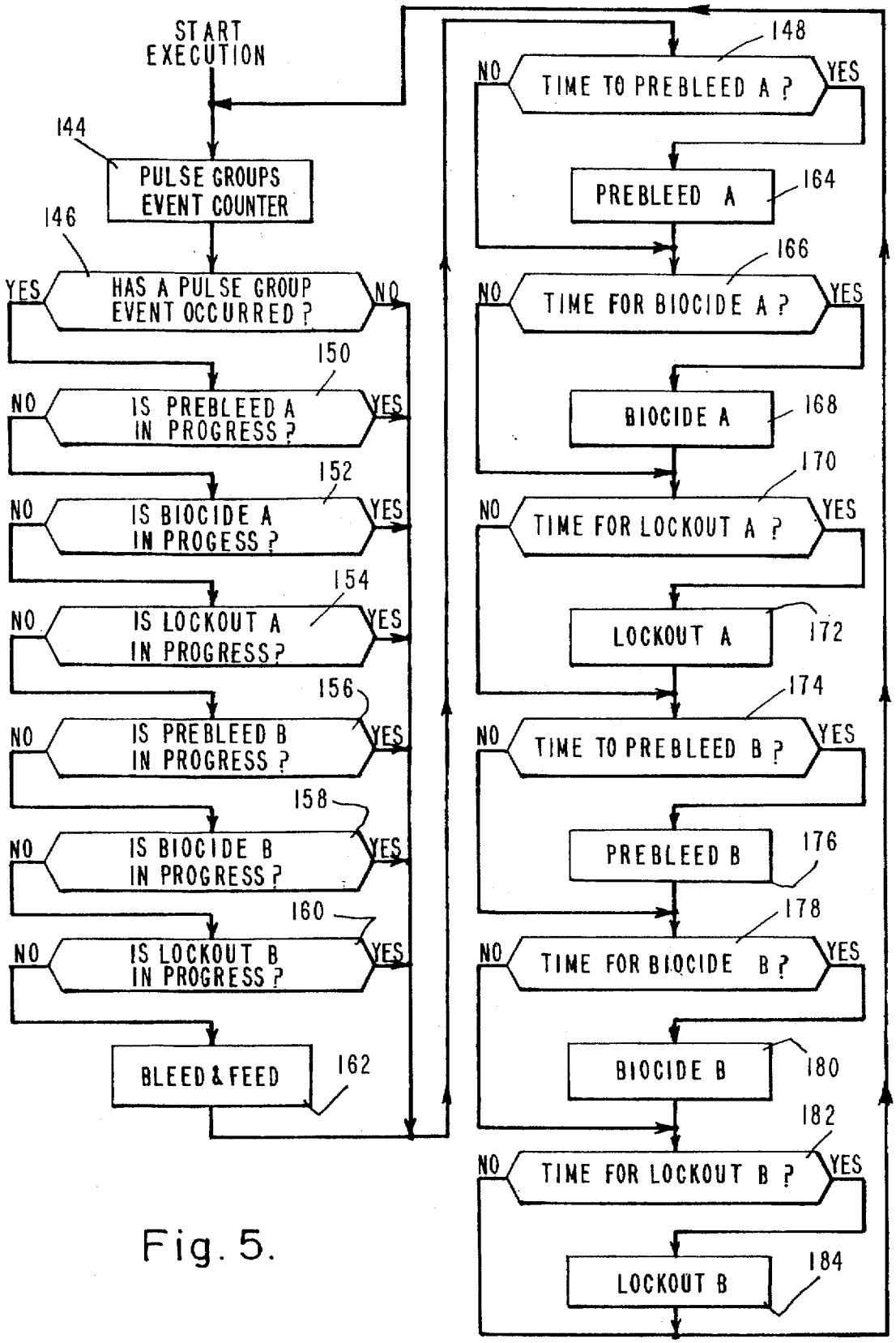
FIG. 5 illustrates a series of steps defining the execution mode of the present invention.

Execution of the present invention is illustrated with reference to the steps sequentially depicted in FIG. 5. In the following description of the execution process, an important prebleed function occurs, which prebleed function is related to the times when biocide insertion is to take place. It is distinguished from bleed, in that prebleed relates to a special blowdown prior to biocide insertion, while bleed relates to regular blowdown. As stated above, blowdown occurs when the level of total dissolved solids (TDS) must be lowered and, therefore, a bleed off process results. However, at the time a biocide insertion is scheduled, the total dissolved solids might not have reached the set value for regular blowdown and bleed off to occur. Thus, to enable biocide insertion to occur and to chemically work for its required time, it is necessary to lock out regular blowdown and, thereafter, to preclude start of the regular blowdown process until after the biocide has had time to function. Accordingly, the present invention causes a special bleed, called "prebleed," to occur prior to biocide insertion. In short, opening of solenoid valve 30 is disabled during the biocide addition process and for the desired period of time thereafter to permit the biocide to work completely, and to prevent any loss of its full effectiveness.

Accordingly, microprocessor 38 receives and counts (enclosure 144) pulse groups from water meter 36 after a certain volume or number of volume of make-up water is added to cooling tower 12. A determination is then made as to whether a pulse group event has occurred (enclosure 146). If none has occurred, then an inquiry is made as to the time for prebleed "A" (enclosure 148). If a pulse group event has occurred, the next step is to inquire if prebleed "A" is in progress (enclosure 150). If so, the process proceeds to the prebleed "A" time inquiry (enclosure 148). If not, an inquiry if biocide "A" is in progress (enclosure 152). If so, the process proceeds to the prebleed "A" time inquiry (enclosure 148). These same inquiries are made to determine if lockout "A" is in progress (enclosure 154), if prebleed "B" is in progress (enclosure 156), if biocide "B" is in progress (enclosure 158) and if lockout "B" is in progress (enclosure 160). If the latter produces a negative response, then bleed and feed commences (enclosure 162), depending upon whether it is time for prebleed "A" (enclosure 148).

The next series of steps in execution (FIG. 5) relates to whether or not the times for prebleed, biocide insertion or lockout are to occur. For each sequential step, negative or positive responses determine the following step. Thus, a positive response to the time to prebleed "A" (enclosure 148) leads to prebleed "A" (enclosure 164) while a negative response leads to a similar inquiry whether or not it is time for biocide "A" (enclosure 166), "yes" to biocide "A" (enclosure 168), "no" to time for lockout "A" (enclosure 170). These same inquiries are sequentially made to determine direct or indirect progress to lockout "A") (enclosure 172), time to prebleed "B" (enclosure 174), prebleed "B" (enclosure 176), time for biocide "B" (enclosure 178), biocide "B" (enclosure 180), time for lockout "E" (enclosure 182), and lockout "B" (enclosure 184) , at which point, the process returns to restart the execution.

Figure 6:
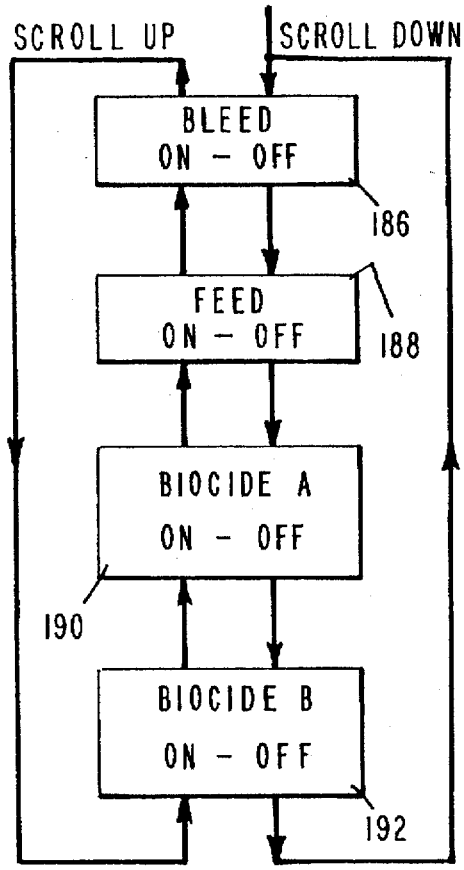
FIG. 6 shows a series of steps defining the test mode of the present invention.

After all programming instructions have been entered, the system can be tested, as outlined in FIG. 6. These testing steps commence when the switch arm of switch 70 is positioned at test "T" (FIG. 2) and in FIG. 3 at contact 108 for "TEST MODE" (enclosure 106). Using the scroll up and scroll down buttons or keys 80 and 82 shown in FIG. 2, the various functions can be testing for bleed (enclosure 186), feed, (enclosure 188), biocide "A" (enclosure 190) and biocide "B" (enclosure 192) in their "ON" and "OFF" modes.

Although the invention has been described with respect to a particular embodiment thereof, it should be realized that various changes and modifications may be made therein without departing from the spirit and scope of the invention.

What is claimed is:

1. An open recirculating evaporative cooling system comprising:

a cooling tower having a heated water inlet and a water collection basin;

a heat exchanger coupled to said cooling tower basin for receiving water therefrom, for removing waste heat from heat producing equipment, and for supplying the heated water to said cooling tower heated water inlet;

sources of water treatment coupled to said cooling tower for supplying anti-fouling and biologically controlling additives thereto;

a blowdown mechanism coupled between said basin and a drain for draining water from said cooling tower basin during a blowdown process to remove accumulated mineral build up following a number of cycles of concentration;

a water supply for supplying a volume of water to said cooling tower to make up for water drained and evaporated therefrom;

a water supply measuring device coupled between said cooling tower and said water supply, for measuring the volume of the make-up water supplied to said cooling tower from said water supply and for providing pulse information corresponding to the volume of water supplied; and a microprocessor controller connected to said water supply measuring device, said blowdown mechanism and said water treatment sources for receiving the pulse information from said water measuring device in terms of volume per pulse, and for coordinated control of both said water treatment sources for the supply of the anti-fouling and biologically controlling additives to said cooling tower and said blowdown mechanism, said microprocessor being programmed to automatically calculate the times and duration for opening said blowdown mechanism and, in coordination with the draining of water, for the supply of the anti-fouling and biologically controlling additives.

2. An open recirculating evaporative cooling system comprising:

a cooling tower having a heated water inlet and a water collection basin;

a heat exchanger coupled to said cooling tower basin for receiving water therefrom, for removing waste heat from heat producing equipment, and for supplying the heated water to said cooling tower heated water inlet;

sources of water treatment coupled to said cooling tower for supplying anti-fouling and biologically controlling additives thereto;

a blowdown mechanism coupled between said basin and a drain for draining water from said cooling tower basin during a blowdown process to remove accumulated mineral build up following a number of cycles of concentration;

a water supply for supplying a volume of water to said cooling tower to make up for water drained and evaporated therefrom;

a water supply measuring device coupled between said cooling tower and said water supply, for measuring the volume of the make-up water supplied to said cooling tower from said water supply and for providing pulse information corresponding to the volume of water supplied; and a microprocessor controller connected to said water supply measuring device, said blowdown mechanism and said water treatment sources for receiving the pulse information from said water measuring device in terms of volume per pulse, and for coordinated control of both said water treatment sources for the supply of the anti-fouling and biologically controlling additives to said cooling tower and said blowdown mechanism, said microprocessor controller being programmed to operate according to the following relationship $$BDT = \frac{MU}{BDR \times CC} \text{ minutes/pulse}$$

where BDT=time of blowdown, MU=make-up (volume per pulse), BDR=blowdown rate (volume per minute), and CC=cycles of concentration.

3. An open recirculating evaporative cooling system comprising:

a cooling tower having a heated water inlet and a water collection basin;

a heat exchanger coupled to said cooling tower basin for receiving water therefrom, for removing waste heat from heat producing equipment, and for supplying the heated water to said cooling tower heated water inlet;

sources of water treatment coupled to said cooling tower for supplying anti-fouling and biologically controlling additives thereto;

a blowdown mechanism coupled between said basin and a drain for draining water from said cooling tower basin during a blowdown process to remove accumulated mineral build up following a number of cycles of concentration;

a water supply for supplying a volume of water to said cooling tower to make up for water drained and evaporated therefrom;

a water supply measuring device coupled between said cooling tower and said water supply, for measuring the volume of the make-up water supplied to said cooling tower from said water supply and for providing pulse information corresponding to the volume of water supplied; and a microprocessor controller connected to said water supply measuring device, said blowdown mechanism and said water treatment sources for receiving the pulse information from said water measuring device in terms of volume per pulse, and for coordinated control of both said water treatment sources for the supply of the anti-fouling and biologically controlling additives to said cooling tower and said blowdown mechanism system said microprocessor controller including a microcontroller unit, a control panel for providing an interface between an operator and said microcontroller unit to enable programming information to be entered therein, a multiplexer-demultiplexer coupled to said water measuring device and between said micro controller unit and said control panel, latches and a relay driver coupled between said microcontroller unit and said respective water treatment sources and said blowdown mechanism, and a display for displaying instructions and results of controller operations.

4. A system according to claim 3 in which said microprocessor controller further includes a read-only memory for storing a controller code and a data memory for receiving the programming information coupled to said microcontroller unit.

5. A system according to claim 4 in which said microprocessor controller is programmed to operate according to the following relationship:

$$BDT = \frac{MU}{BDR \times CC} \text{ minutes/pulse}$$

where BDT=time of blowdown, MU=make-up (volume per pulse), BDR=blowdown rate (volume per minute), and CC=cycles of concentration.

6. A system according to claim 5 in which said heat exchanger is coupled to said cooling tower basin for receiving water therefrom, said blowdown mechanism includes a solenoid valve operated by said microprocessor controller, and said sources of water treatment include means for supplying corrosion, scale and biological fouling controlling additives thereto.

7. In an open recirculating evaporative cooling system having a cooling tower, a drain coupleable to the tower and operable during a tower blowdown process to bleed off accumulated mineral build up following a number of cycles of concentration, water treatment sources for supplying anti-fouling additives to the tower, and a supply for feeding make-up water to the tower, a microprocessor for controlling the system, comprising:

a microcontroller unit programmed to operate according to the following relationship:

$$BDT = \frac{MU}{BDR \times CC} \text{ minutes/pulse}$$

where BDT=time of blowdown, MU=make-up (volume per pulse), BDR=blowdown rate (volume per minute), and CC=cycles of concentration.

8. A microprocessor according to claim 7 wherein the system includes a water measuring device for measuring the volume of supplied make-up water (in terms of volume per pulse group), further comprising:

a control panel for providing an interface between an operator and said microcontroller unit;

a multiplexer-demultiplexer coupled to the water measuring device and between said microcontroller unit and said control panel;

latches and a relay driver coupled between said microcontroller unit and the respective water treatment sources and the drain; and a display for displaying instructions and results of microprocessor operations.

9. A microprocessor according to claim 8 for programming thereof, further comprising:

means for initiating the programming to enter a general password;

means for entering current date and time information;

means for entering the cycles of concentration with related bleed and feed cycle time calculations;

means for entering make-up information with related bleed and feed cycle time calculations;

means for entering blowdown rate information with related bleed and feed cycle time calculations;

means for entering information related to the number of pulses in the group;

means for entering biocide schedules and related times for locking out the blowdown process; and means for customizing the password.

10. A microprocessor according to claim 9 for execution of the program, further comprising:

means for receiving and counting the pulse groups after a predetermined volume of make-up water is supplied to the cooling tower;

means for determining whether a pulse group event has occurred;

if none has occurred, means for inquiring if time for a prebleed operation has occurred;

if a pulse group event has occurred, means for inquiring if a prebleed operation is in progress;

if a prebleed operation has occurred, means for inquiring if time for a prebleed has occurred;

if a prebleed operation has not occurred, means for inquiring if insertion of a biocide is in progress;

if biocide insertion is in progress, means for inquiring if time for a prebleed operation has occurred;

if biocide insertion is not in progress, means for inquiring if a lockout is in progress;

if lockout is in progress, means for inquiring if a prebleed operation is in progress;

if lockout is not in progress, means for commencing bleed and feed operations and for inquiring if the time for a prebleed is to occur;

means for determining whether or not the times for prebleed, biocide insertion or lockout are to occur, with negative or positive responses determining timing and execution of prebleed, biocide, lockout, and subsequent return to restart of execution.

11. In an open recirculating evaporative cooling system where water is lost through evaporation and through bleed off during a blowdown process, apparatus for replacing the lost water with make-up water, comprising:

a pulse group detecting mechanism that detects each pulse group of the number of pulses reflecting the volume of the make-up water;

a calculator that calculates the time of bleed off that reflects the volume of bled off water; and an executor that executes a timed program for bleed off by correlating the pulse groups and the water bled off.

12. In an open recirculating evaporative cooling system having a cooling tower, a drain coupleable to the tower and operable during a tower blowdown process to bleed off accumulated mineral build up following a number of cycles of concentration, water treatment sources for supplying anti-fouling additives to the tower, a supply for feeding make-up water to the tower, and a mechanism which generates pulses that reflects the volume of the make-up water, a microprocessor for controlling the system, a method for programming the system comprising the steps of:

initiating programming to enter a general password;

entering current date and time information;

entering the cycles of concentration with related bleed and feed cycle time calculations;

entering make-up information with related bleed and feed cycle time calculations;

entering blowdown rate information with related bleed and feed cycle time calculations;

entering information related to the number of the pulses in a group thereof;

entering biocide schedules and related lockout duration; and customizing the password.

13. In an open recirculating evaporative cooling system having a cooling tower, a drain coupleable to the tower and operable during a tower blowdown process to bleed off accumulated mineral build up following a number of cycles of concentration, water treatment sources for supplying anti-fouling additives to the tower, a supply for feeding make-up water to the tower, and a mechanism which generates pulses that reflects the volume of the make-up water, a microprocessor for controlling the system, a method for executing the system comprising the steps of:

receiving and counting groups of the pulses after a predetermined volume of make-up water is fed to the cooling tower;

determining whether a pulse group event has occurred;

if none has occurred, inquiring if time for a prebleed operation has occurred;

if a pulse group event has occurred, inquiring if a prebleed operation is in progress;

if a prebleed operation has occurred, inquiring if time for a prebleed operation has occurred;

if a prebleed operation has not occurred, inquiring if insertion of a biocide is in progress;

if biocide insertion is in progress, inquiring if time for a prebleed operation has occurred;

if biocide insertion is not in progress, inquiring if a lockout of the blowdown process is in progress;

if lockout is in progress, inquiring if a prebleed operation is in progress;

if lockout is not in progress, commencing bleed and feed operations and for inquiring if the time for a prebleed operation is to occur;

determining whether or not the times for prebleed, biocide insertion or lockout are to occur, with negative or positive responses determining timing and execution of prebleed, biocide, lockout, and subsequent return to restart of execution.

14. In an open recirculating evaporative cooling system, a method for replacing evaporated water and bled off cooling water with dissolved minerals and anti-fouling chemicals with make-up water and fresh anti-fouling chemicals, comprising the steps of:

detecting the number of pulses in a group that reflects the volume of the replaced make-up water;

calculating the time of bleed off that reflects the volume of bled off water; and correlating the cycles of concentration permitted with the volume per pulse of the replaced make-up water and the volume of water per unit of time of the water bled off in said detecting and calculating steps, in which the cycles of concentration (CC) is determined by the equation $$CC = \frac{TDS \text{ content in the cooling tower water}}{TDS \text{ content in make-up water}}$$

wherein TDS is the total dissolved mineral solids.

15. A method according to claim 14 further comprising the step of programming the microprocessor controller to operate according to the following relationship:

$$BDT = \frac{MU}{BDR \times CC} \text{ minutes/pulse}$$

where BDT=time of blowdown, MU=make-up (volume per pulse), BDR=blowdown rate (volume per minute), and CC=cycles of concentration.

16. In an open recirculating evaporative cooling system where water is lost through evaporation and through bleed off during a blowdown process, a method for replacing the lost water with make-up water, comprising the steps of:

detecting each pulse group of the number of pulses that reflect the volume of the make-up water;

calculating the time of bleed off that reflects the volume of bled off water; and executing a timed program for bleed off by correlating the pulses and the time that reflects the volume of the water bled off.

17. An open recirculating evaporative cooling system comprising:

a cooling tower having a heated water inlet and a water collection basin;

a heat exchanger coupled to said cooling tower basin for receiving water therefrom, for removing waste heat from heat producing equipment, and for supplying the heated water to said cooling tower heated water inlet;

sources of water treatment coupled to said cooling tower for supplying anti-fouling and biologically controlling additives thereto;

a blowdown mechanism coupled between said basin and a drain for draining water from said cooling tower basin during a blowdown process to remove accumulated mineral build up following a number of cycles of concentration;

a water supply for supplying a volume of water to said cooling tower to make up for water drained and evaporated therefrom;

a water supply measuring device coupled between said cooling tower and said water supply, for measuring the volume of the make-up water supplied to said cooling tower from said water supply and for providing pulse information corresponding to the volume of water supplied; and a microprocessor controller connected to said water supply measuring device, said blowdown mechanism and said water treatment sources for receiving the pulse information from said water measuring device in terms of volume per pulse, for converting the volume per pulse measurement to a minutes of blowdown per pulse using programmed cycles of concentration data and blowdown rate data in terms of gallons per minute, and for coordinated control of both said water treatment sources for the supply of the anti-fouling and biologically controlling additives to said cooling tower and said blowdown mechanism.

* * * * *